US012765685B2

(12) United States Patent
Drake

(10) Patent No.: US 12,765,685 B2
(45) Date of Patent: Oct. 20, 2026

(54) SADDLE SLEEPER

(71) Applicant: Dragovich Creations, LLC, Arvada, CO (US)

(72) Inventor: Brad Drake, Golden, CO (US)

(73) Assignee: Dragovich Creations, LLC, Arvada, CO (US)

( * ) Notice: Subject to any disclaimer, the term of this patent is extended or adjusted under 35 U.S.C. 154(b) by 1 day.

(21) Appl. No.: 18/903,282

(22) Filed: Oct. 1, 2024

(65) Prior Publication Data

US 2025/0017386 A1 Jan. 16, 2025

Related U.S. Application Data

(63) Continuation of application No. PCT/US2023/015630, filed on Mar. 20, 2023.

(60) Provisional application No. 63/326,732, filed on Apr. 1, 2022.

(51) Int. Cl.

| | |
|---|---|
| ***A47C 20/04*** | (2006.01) |
| ***A47C 20/02*** | (2006.01) |
| ***A47C 20/08*** | (2006.01) |

(52) U.S. Cl.

CPC ..... *A47C 20/04* (2013.01); *A47C 20/08* (2013.01); *A47C 20/027* (2013.01)

(58) Field of Classification Search

CPC ..... A47C 20/04; A47C 20/08; A47C 20/043; A47C 20/047; A47C 20/027; A61G 7/015; A61G 7/002; A61G 7/07; A61G 7/065

USPC ..... 5/722, 657, 652, 634, 633, 655

See application file for complete search history.

(56) References Cited

U.S. PATENT DOCUMENTS

| | | | | |
|---|---|---|---|---|
| 2,563,700 | A * | 8/1951 | Wolf | A47G 9/1009 5/640 |
| 3,220,771 | A | 11/1965 | Doss, Sr. | |
| 4,754,510 | A * | 7/1988 | King | A47C 20/023 D6/601 |
| 4,765,616 | A | 8/1988 | Wolff | |
| 5,100,131 | A | 3/1992 | Fog | |
| 5,649,886 | A | 7/1997 | Danylicko | |
| 5,664,271 | A * | 9/1997 | Bellavance | A47C 20/021 5/652 |
| 5,946,749 | A * | 9/1999 | Sewell | A47C 1/143 5/507.1 |
| 6,065,808 | A | 5/2000 | Tinsley | |
| 6,287,243 | B1 | 9/2001 | Isom et al. | |
| 6,385,783 | B1 | 5/2002 | Ellason | |

(Continued)

FOREIGN PATENT DOCUMENTS

WO WO-2023204917 A1 * 10/2023 ..... A47C 20/04

OTHER PUBLICATIONS

International Search Authority United States, International Search Report and Written Opinion for PCT Appl. PCT/US2023/015630, dated Jun. 14, 2023, 6 pgs.

*Primary Examiner* — Robert G Santos

(74) *Attorney, Agent, or Firm* — BrainSpark Associates, LLC

(57) ABSTRACT

The saddle sleeper allows a person (e.g., adults or children) to sleep in an angled position on their stomach (e.g., upper torso) and head in a straddle, sitting-like position, which helps reduce a variety of symptoms that are tied to specific medical conditions. In one example, the angled position may help a person to reduce and/or eliminate congestion and/or coughing while attempting to sleep when it's due to a common cold, flu or disease.

19 Claims, 12 Drawing Sheets

(56) References Cited

U.S. PATENT DOCUMENTS

| | | | | |
|---|---|---|---|---|
| 6,543,853 | B1 | 4/2003 | Splane, Jr. | |
| 6,795,990 | B1 * | 9/2004 | Hutchinson | A47C 20/027 5/652 |
| 7,178,868 | B2 | 2/2007 | Richardson et al. | |
| 7,194,772 | B2 * | 3/2007 | Rie | E03D 1/01 4/353 |
| 7,322,061 | B2 * | 1/2008 | Carroll | A47D 13/083 5/640 |
| 7,454,801 | B1 | 11/2008 | Rie | |
| 8,863,334 | B2 * | 10/2014 | Gibbons | A47C 20/027 5/652 |
| 10,925,408 | B2 * | 2/2021 | Nam | A47C 19/12 |
| D1,081,176 | S * | 7/2025 | Drake | D6/382 |
| 2006/0137082 | A1 * | 6/2006 | Rie | E03D 11/02 4/254 |
| 2007/0052275 | A1 | 3/2007 | Ghilzai | |
| 2007/0209115 | A1 * | 9/2007 | Carroll | A47C 20/027 5/636 |
| 2008/0178388 | A1 | 7/2008 | Schermel | |
| 2009/0284064 | A1 | 11/2009 | Maynard, Jr. | |
| 2012/0158138 | A1 | 6/2012 | Brinkerhoff et al. | |
| 2014/0215719 | A1 * | 8/2014 | Gibbons | A47C 20/021 5/632 |
| 2018/0317663 | A1 * | 11/2018 | Nam | A61G 13/122 |
| 2025/0017386 | A1 * | 1/2025 | Drake | A61G 7/07 |

* cited by examiner

SADDLE SLEEPER

CROSS-REFERENCE TO RELATED APPLICATIONS

This application is a continuation application of PCT International Application No. PCT/US2023/015630 filed on Mar. 20, 2023, entitled "Saddle Sleeper," which claims the benefit of U.S. Provisional Application No. 63/326,732 entitled "Incline Sleeper" filed Apr. 1, 2022, the disclosures of which are incorporated by reference herein in their entireties.

TECHNICAL FIELD

The disclosure relates to a bed, sleeper or cradle that includes angles of inclination to allow a person to be supported comfortably during use. More specifically, the disclosure relates to a sleeper or bed that includes angles of inclination to allow a person to sleep in straddled, forward facing position to reduce symptoms due to a variety of medical conditions.

BACKGROUND OF THE INVENTION

It can be difficult for children with the flu, asthma, upper respiratory infections, and allergies to fall asleep and stay asleep at night due to constant coughing, hacking, and wheezing. This can result in excess drainage and mucus, which can contaminate pillows, blankets and sheets, as well as create sore throats that make it difficult to eat or swallow during the waking hours. Unfortunately, parents can also lose sleep from the constant noise and the overall concern for their children's health.

Currently, there are various inclined beds on the market, but these apparatuses require children to lie on their back or side, allowing congestion to build, and can subject children to falling from or sliding off of the incline to the bottom, possibly becoming pinned during the night. The current inclined beds contain sleeping surfaces that require a user to sleep on his or her back and do not enable a user to sleep in a face down position in a manner recommended for optimal drainage.

and

Figure 6A:
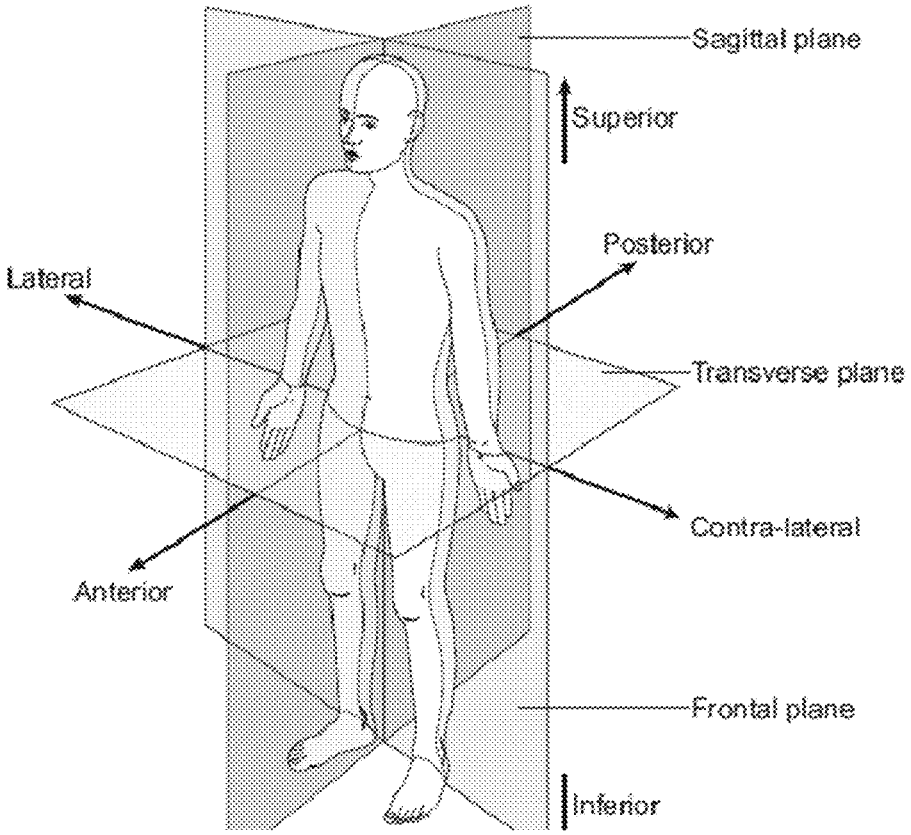
Figure 6B:
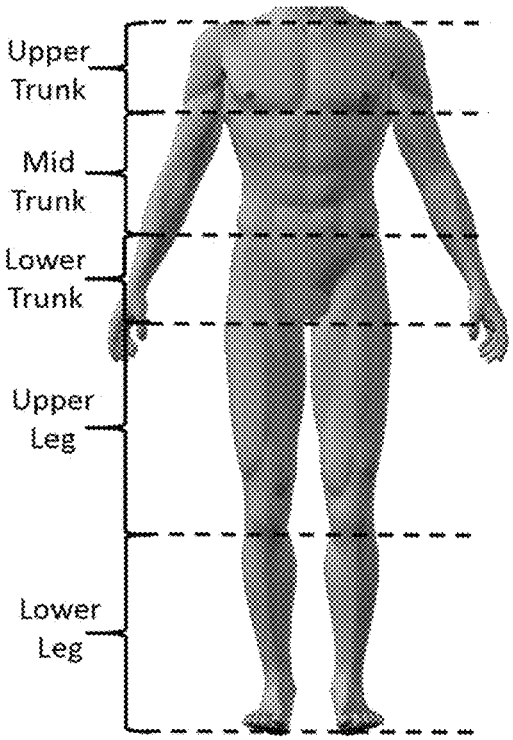

FIGS. 6A-6B display different embodiments of different regions and planes of a human anatomy.

BRIEF SUMMARY OF INVENTION

In one embodiment, the sleeper comprising: a first surface, the first surface comprises a first top width, a first bottom width, a first surface shape and a first surface angle, the first bottom width is smaller than the first top width, the first surface is configured to support at least a portion of a ventral side of an upper torso of a person; a second surface, the second surface comprises a second top width, a second bottom width, a second surface shape and a second surface angle, the second bottom width is smaller than the second top width, the second surface is configured to support at least a portion of a dorsal side of a buttocks of a person; the first surface and the second surface intersect at an intersection region at a surface orientation angle, the intersection region includes an intersection height and an intersection width; and a base, the base supporting the first surface and the second surface.

In another embodiment, the sleeper comprising: a first surface, the first surface comprises a first surface width, a first surface shape and a first surface angle, the first surface is configured to support at least a portion of a ventral side of an upper torso of a person; a second surface, the second surface comprises a second surface width, a second surface shape and a second surface angle, the second surface is configured to support least a portion of a buttocks of a person; the first surface and the second surface intersect at a surface orientation angle at an intersection region, the intersection region includes an intersection width, intersection height, the intersection width comprises a smaller width than the first surface width and a second surface width; and a base, the base supporting the first surface and the second surface.

In another embodiment, the adjustable sleeper comprising: a first surface, a second surface, a base and a locking mechanism; the first surface comprises a first surface width, a first surface shape and a first surface angle, the first surface is configured to support at least a portion of a ventral side of an upper torso of a person; the second surface comprises a second surface width, a second surface shape and a second surface angle, the second surface is configured to support least a portion of a buttocks of a person; the first surface and the second surface intersect at one or more surface orientation angles at an intersection region, the intersection region includes an intersection width, intersection height, the intersection width comprises a smaller width than the first surface width and a second surface width; the base comprising a first portion, a second portion and one or more base orientation angles, the first portion of the base supporting the first surface and the second portion of the base supporting the second surface, the first portion of the base moves relative to the second portion of the base while changing the base orientation angle and the surface orientation angle of the first surface and second surface; the locking mechanism engaging with the base, first surface and/or second surface to secure or set the desired one or more base orientation angle or the one or more surface orientation angle. The adjustable sleeper is movable from a first position, an unlocked, folded configuration, to a second position, a locked, unfolded or open configuration.

DETAILED DESCRIPTION OF INVENTION

Figure 1A:
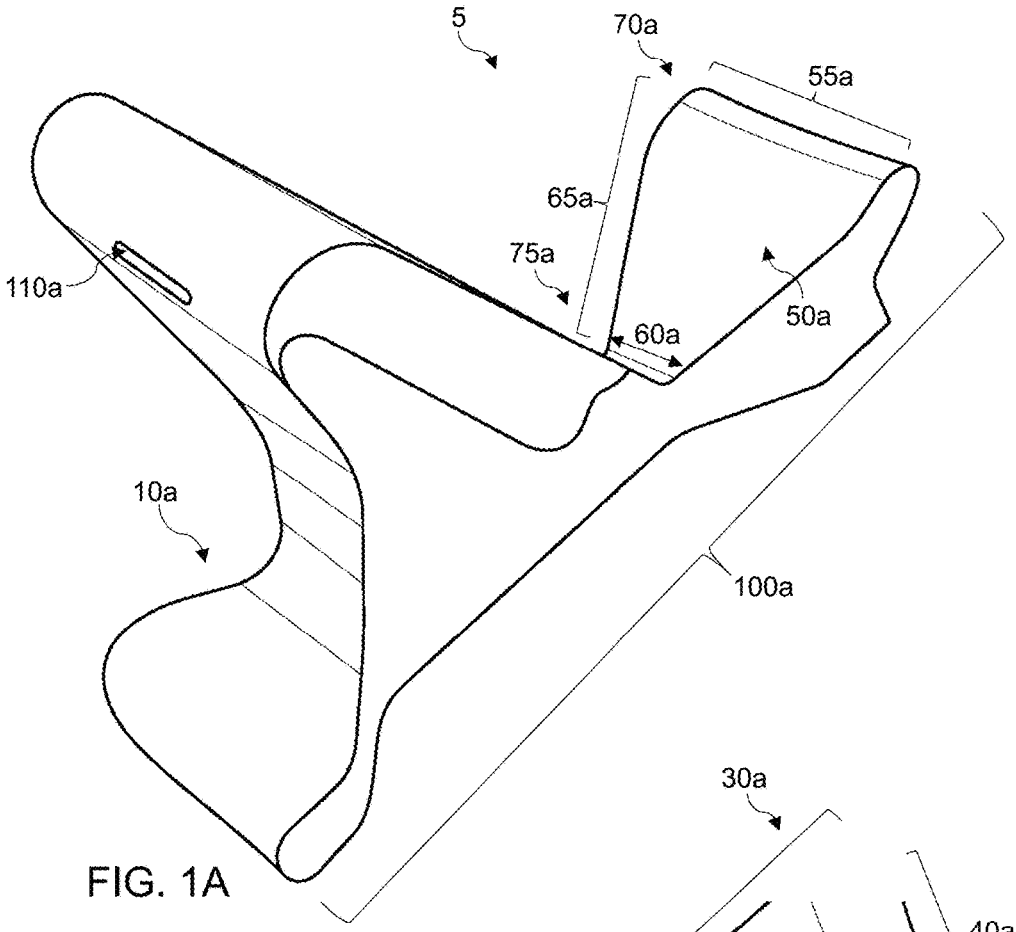
FIGS. 1A-1C display multiple views of a first embodiment of a saddle sleeper without padding.
Figure 1B:
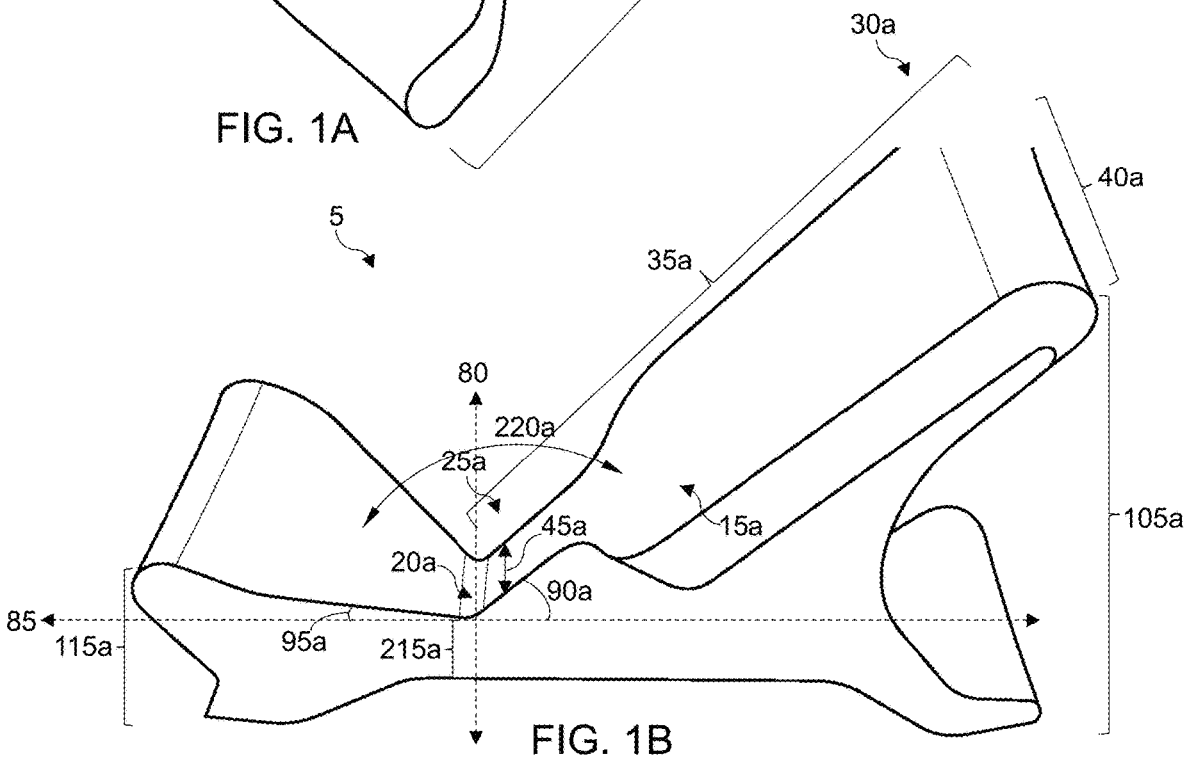
Figure 1C:
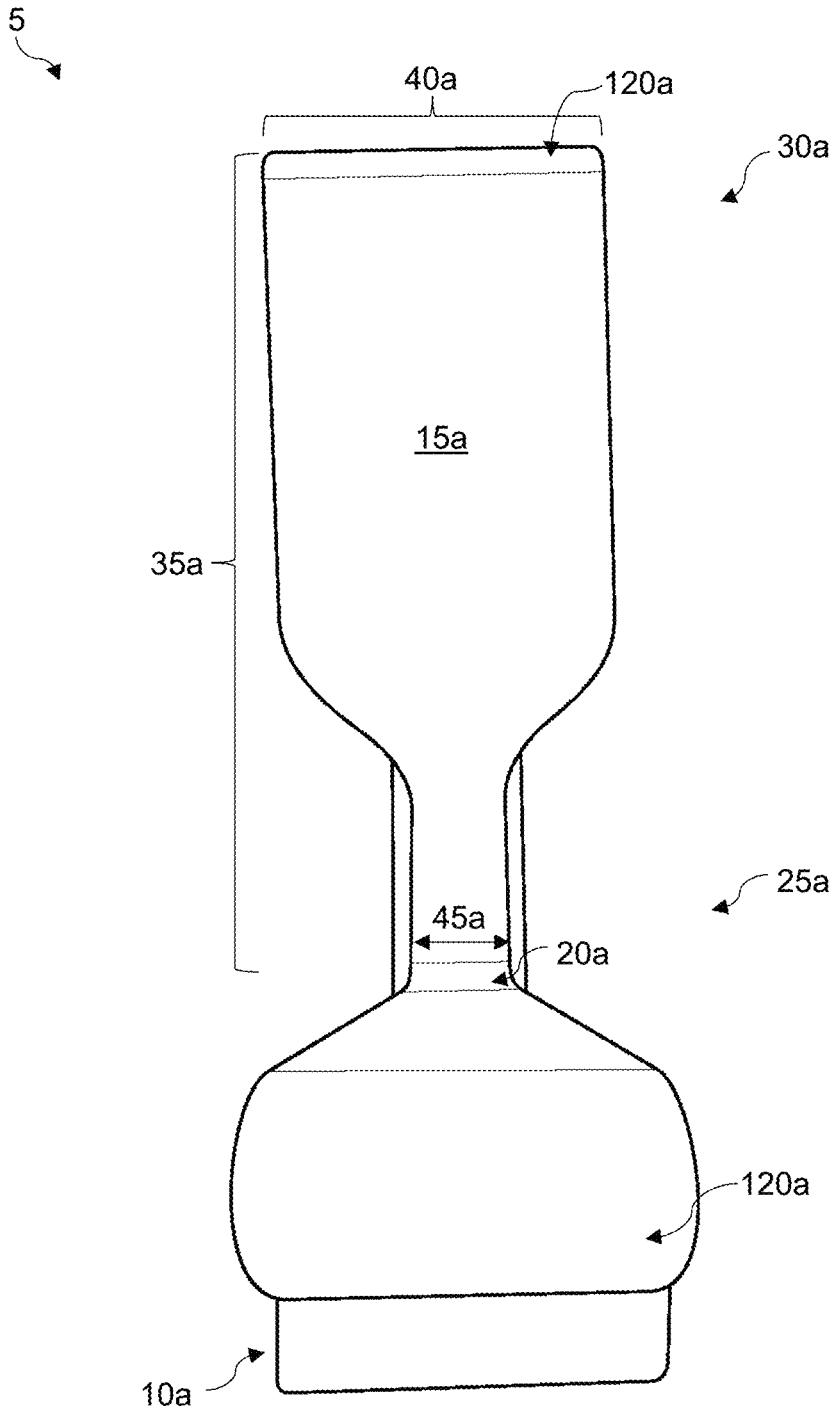
Figure 2A:
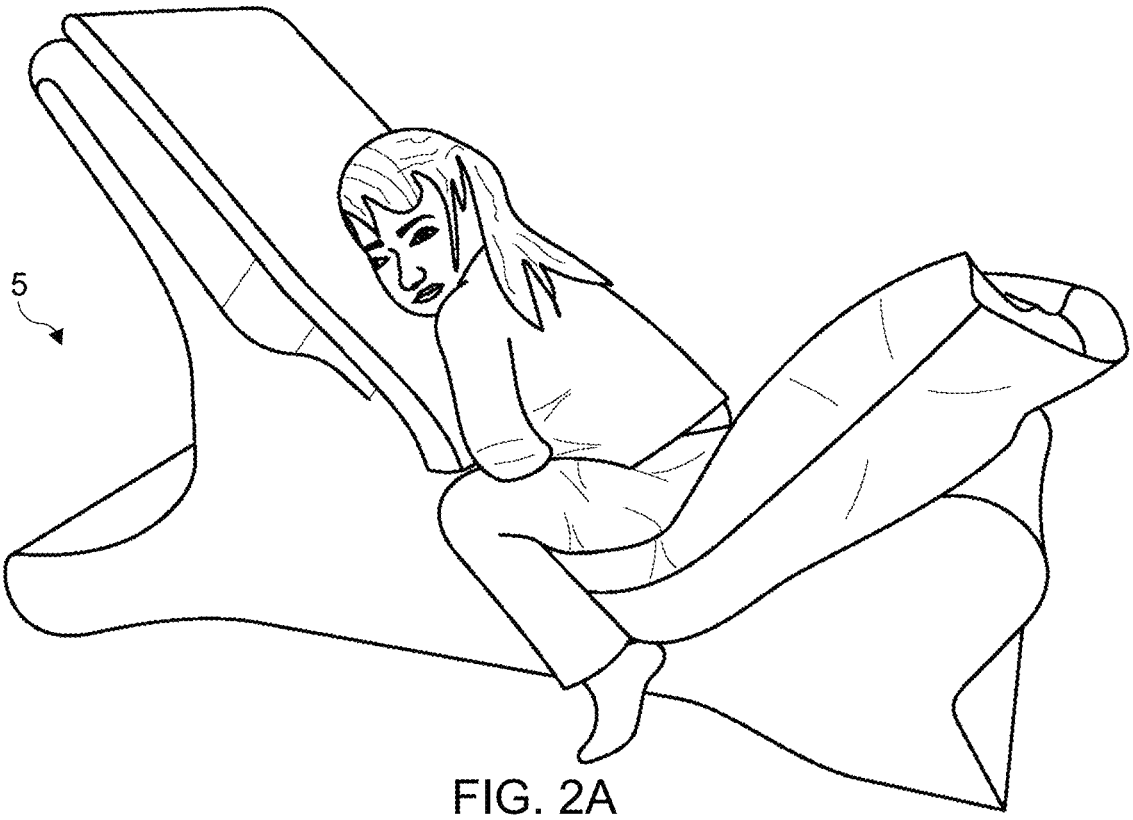
FIGS. 2A-2B display multiple views of a young child sleeping the saddle sleeper of FIGS. 1A-1C with pads.
Figure 2B:
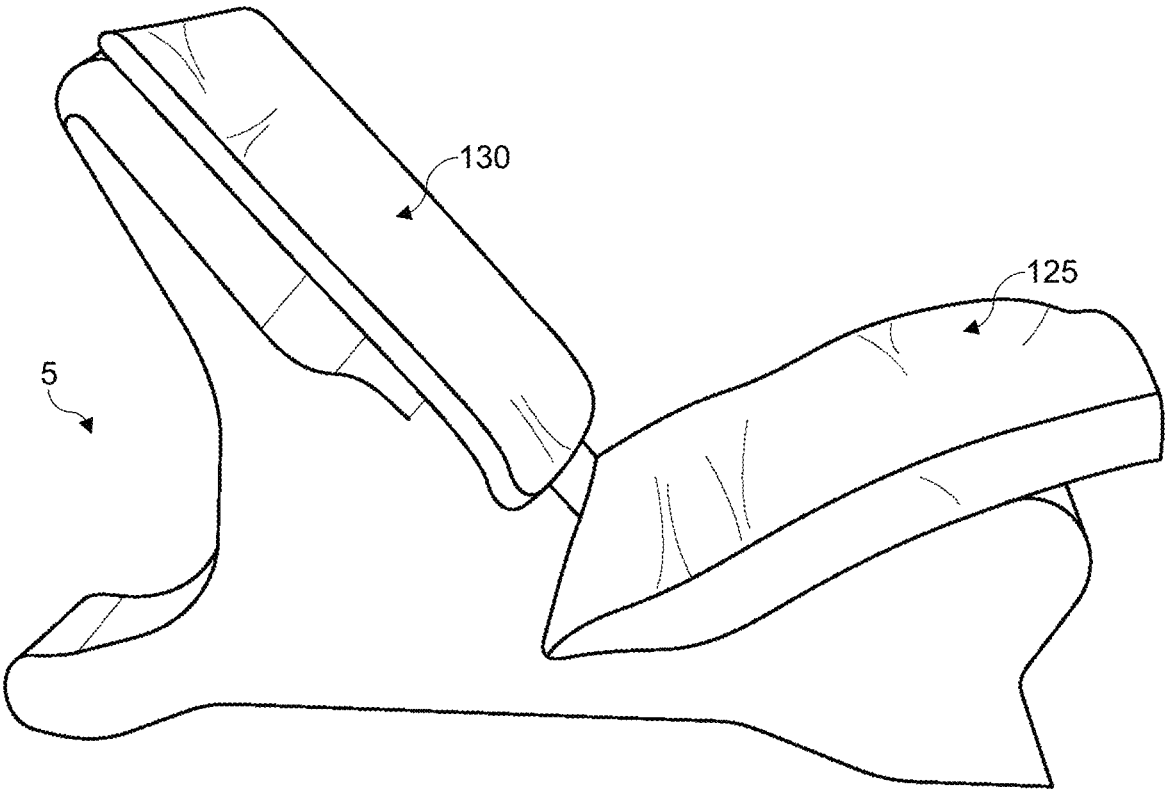
Figure 3A:
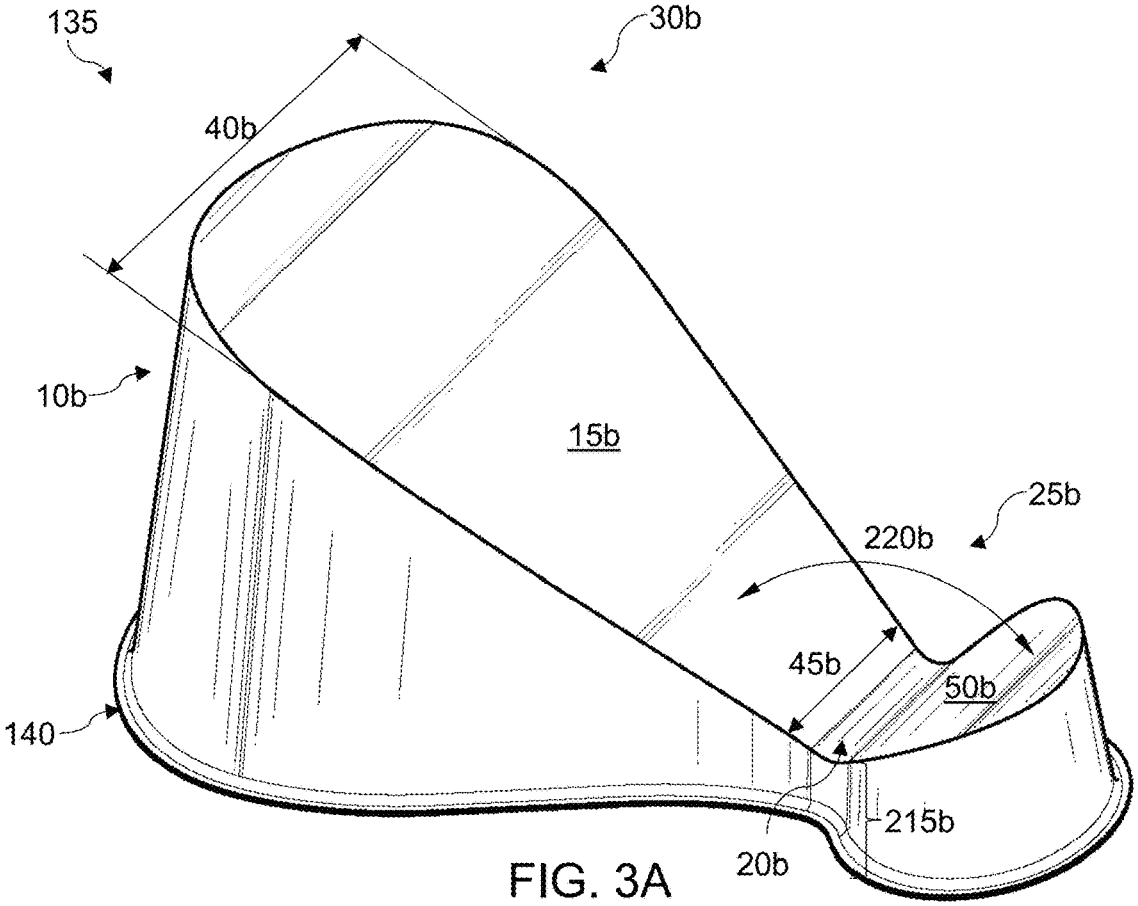
FIGS. 3A-3D display multiple views a second embodiment of a saddle sleeper.
Figure 3B:
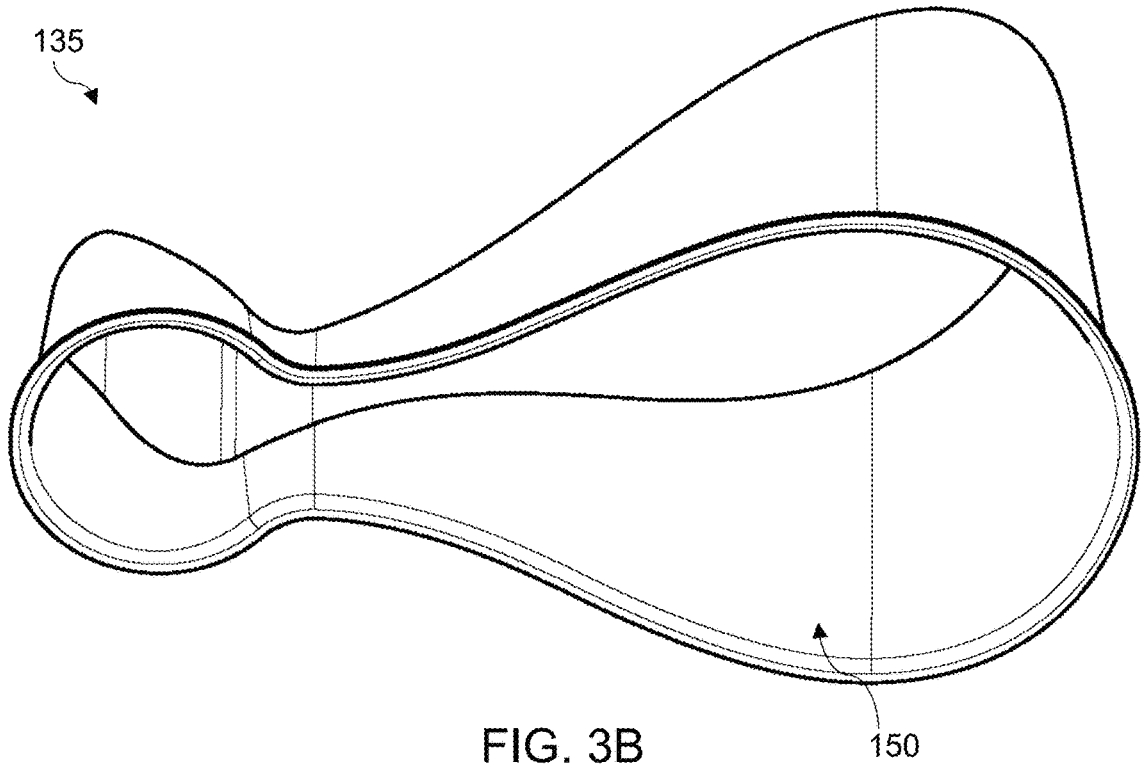
Figure 3C:
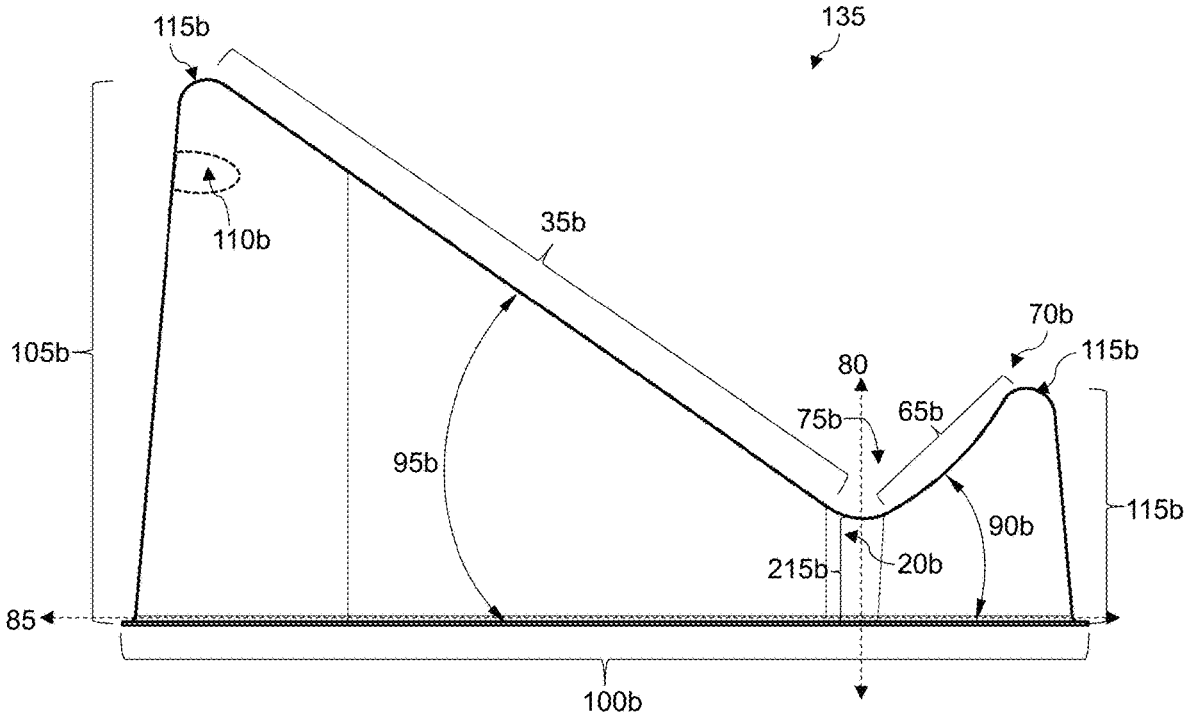
Figure 3D:
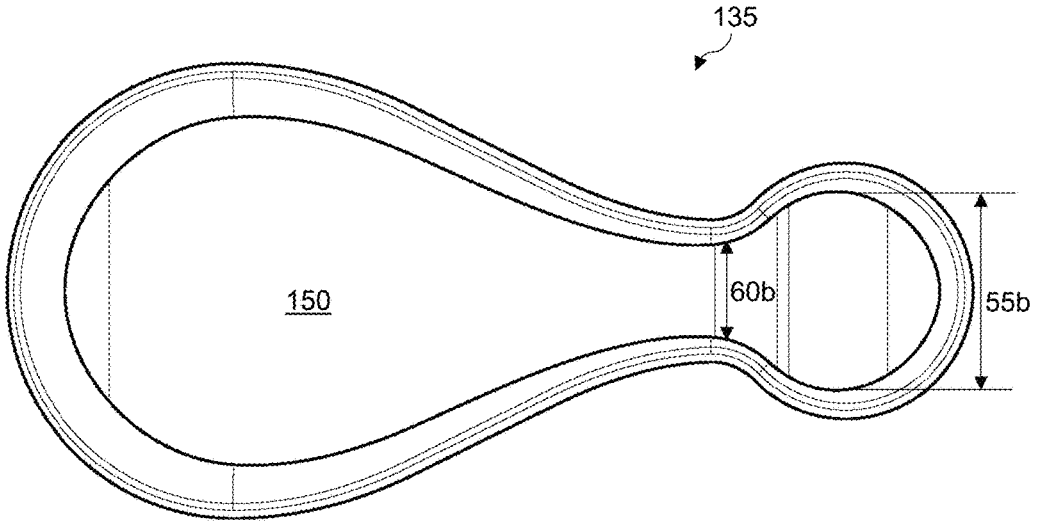
Figure 4A:
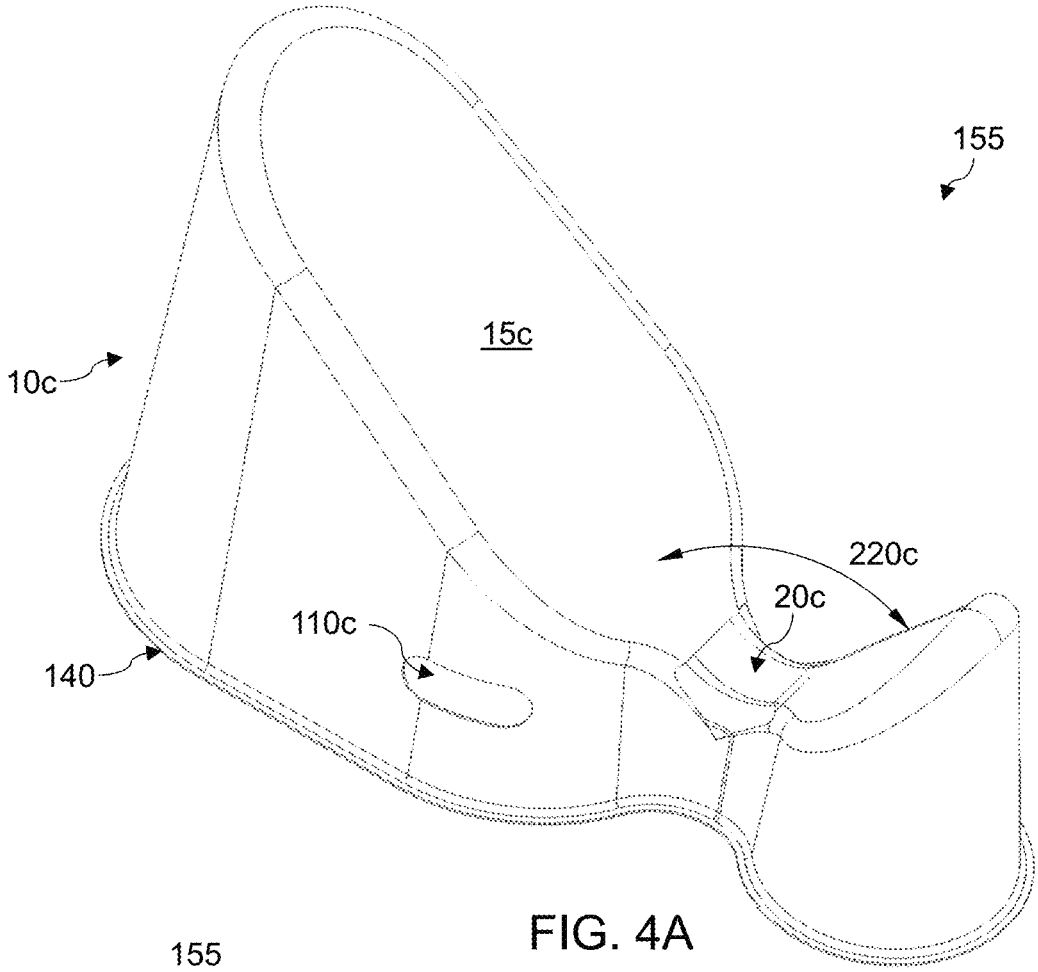
FIGS. 4A-4H display multiple views and a cross-section view of a third embodiment of a saddle sleeper.
Figure 4B:
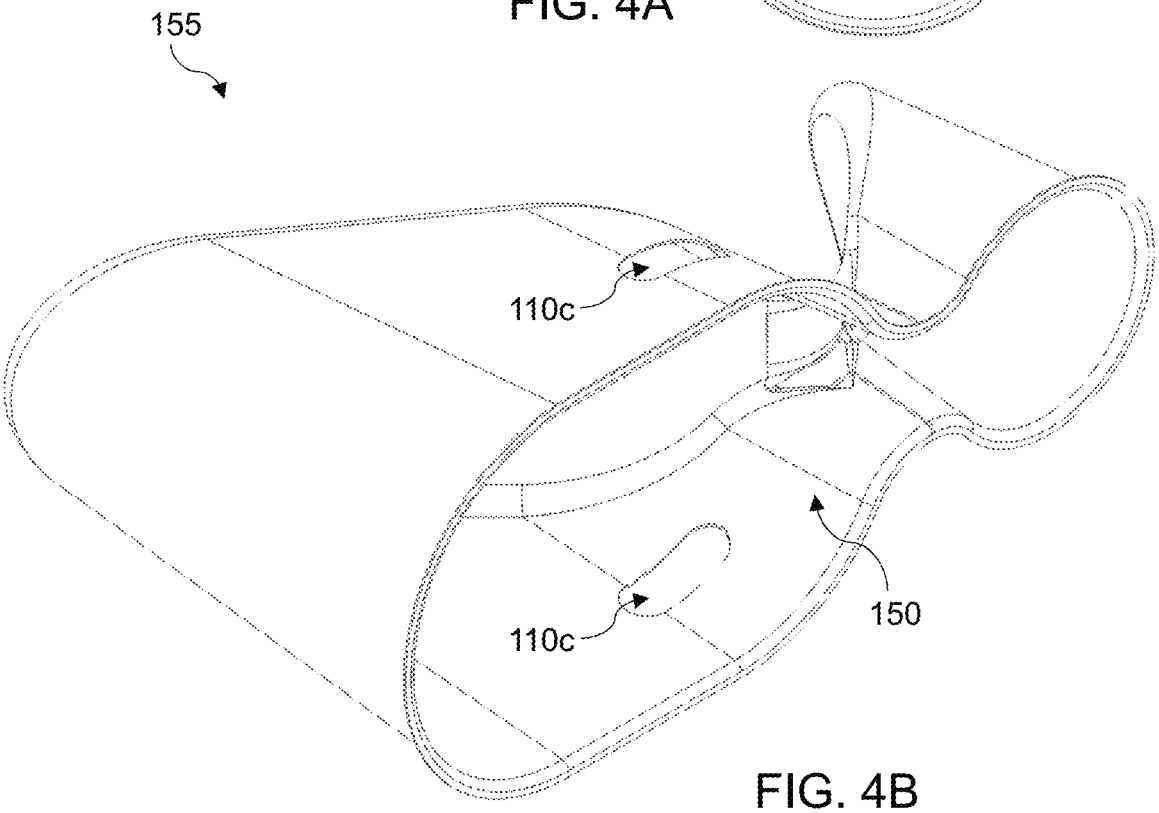
Figure 4C:
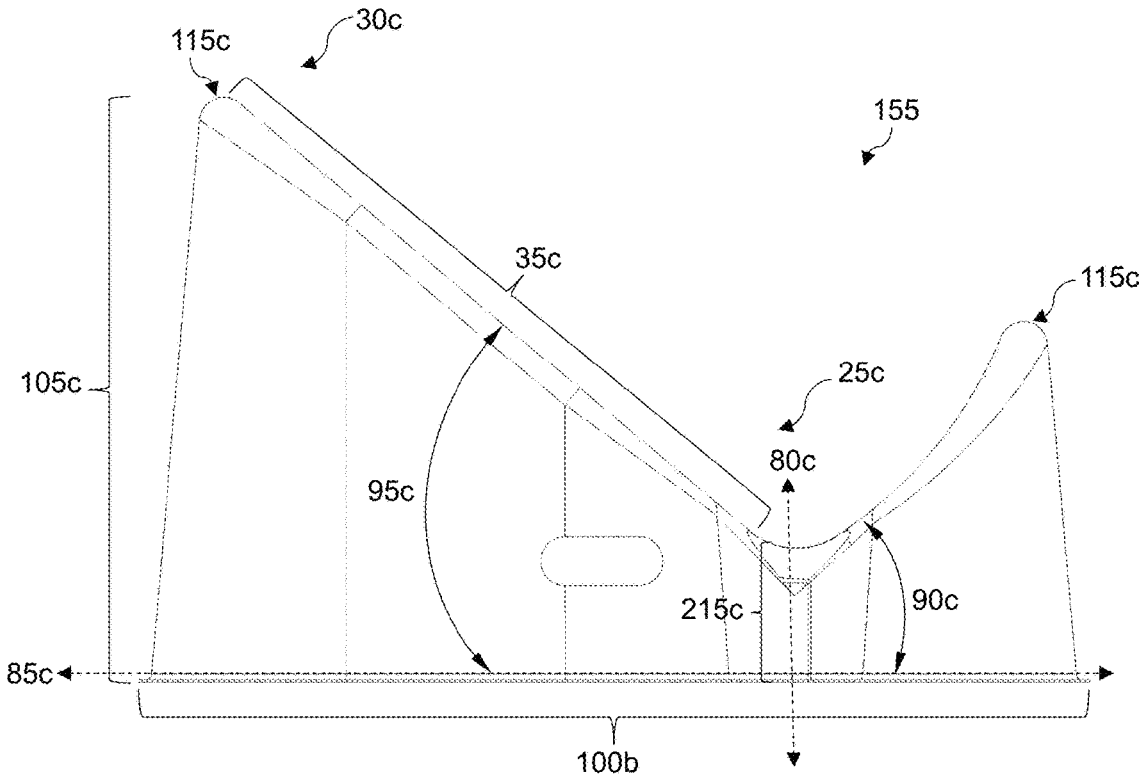
Figure 4D:
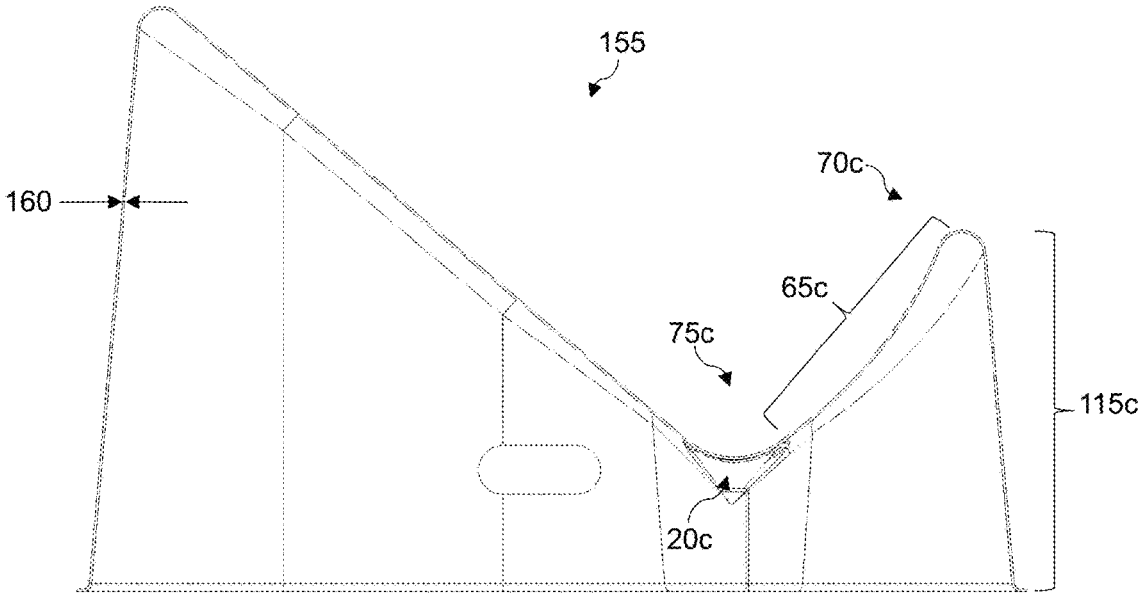
Figure 4E:
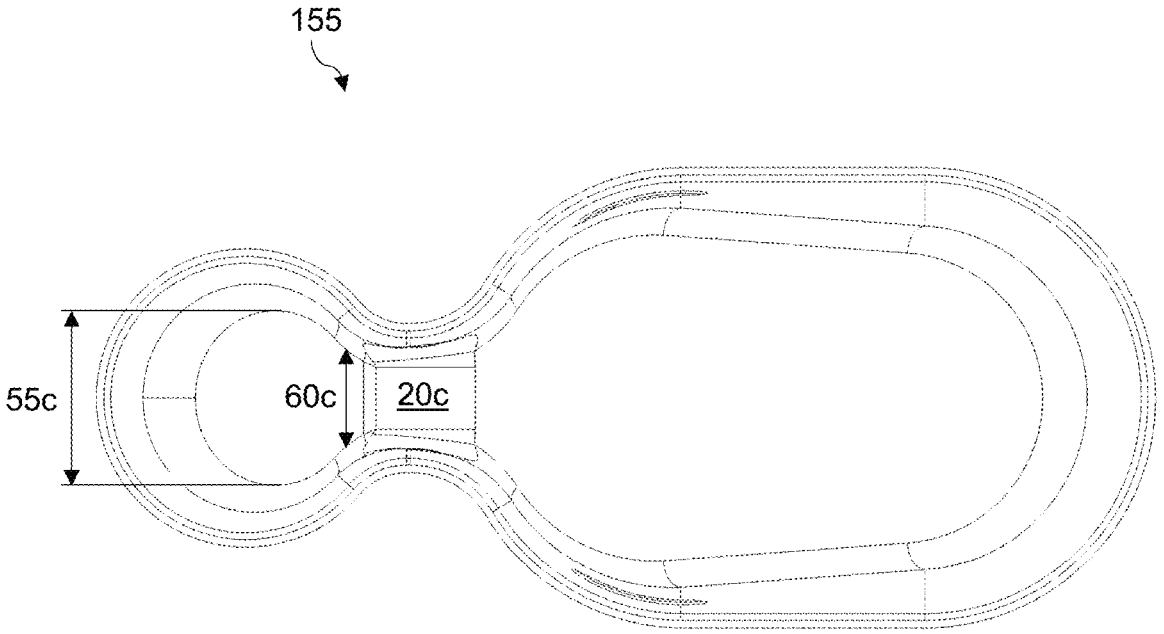
Figure 4F:
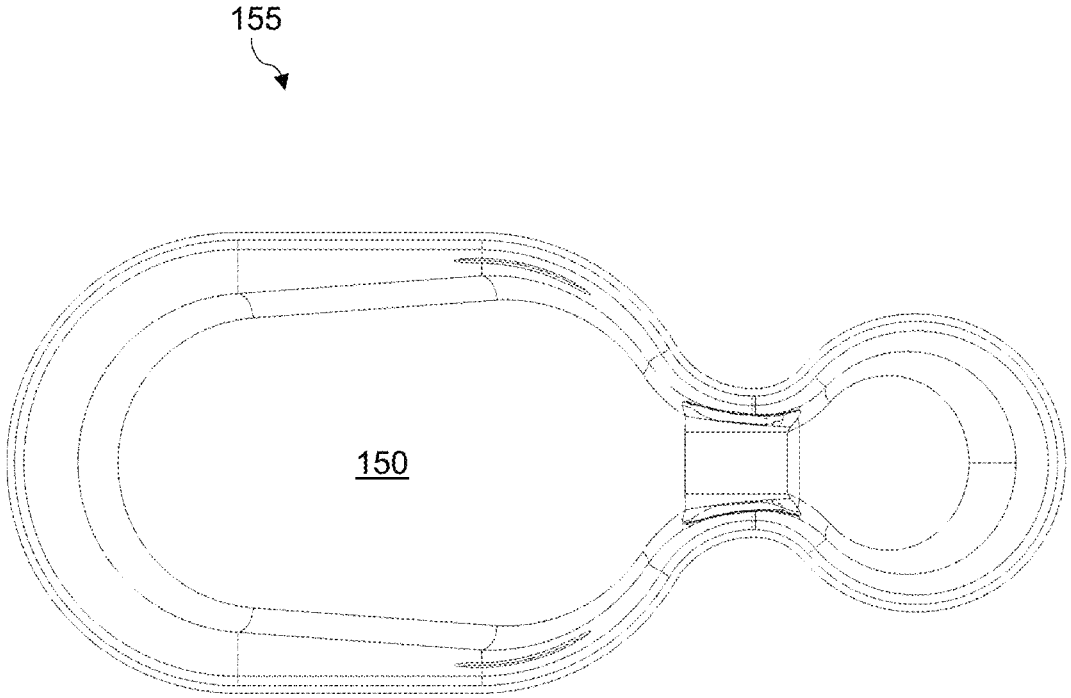
Figure 4G:
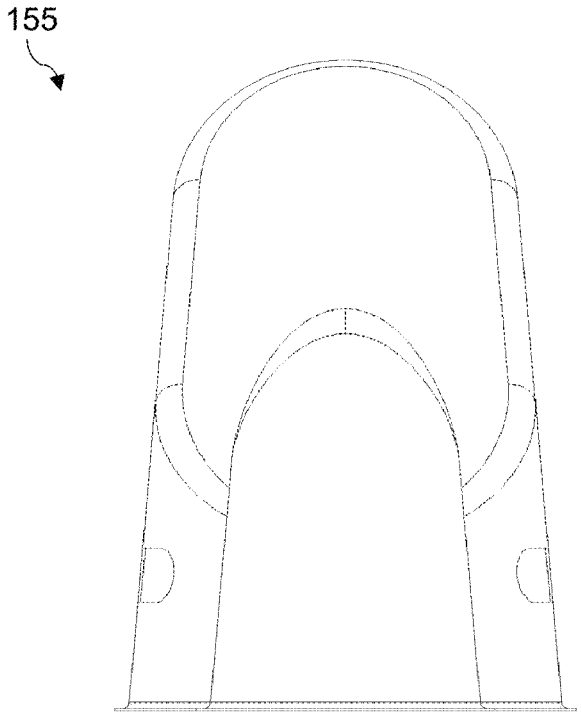
Figure 4H:
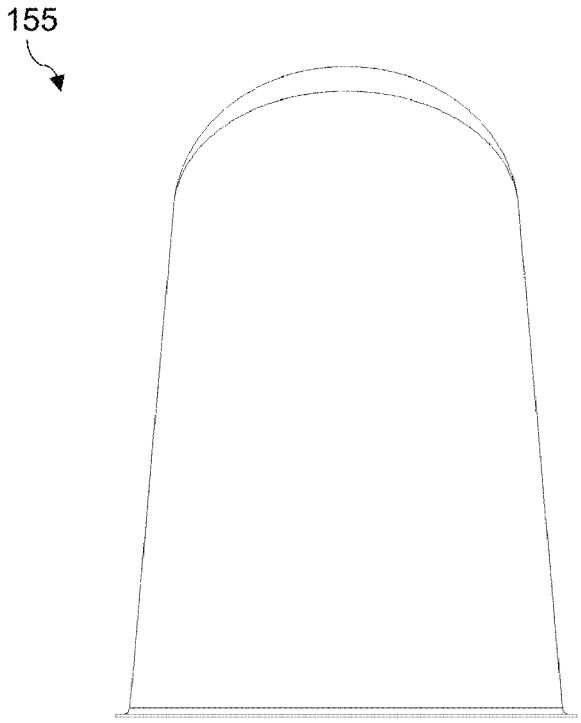
Figure 5A:
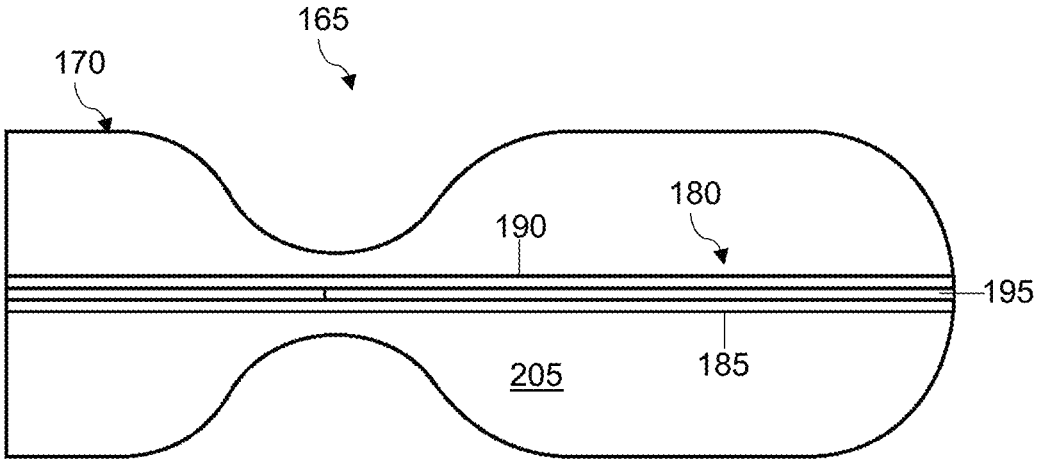
FIGS. 5A-5C display multiple views of a fourth embodiment of a folded saddle sleeper.
Figure 5B:
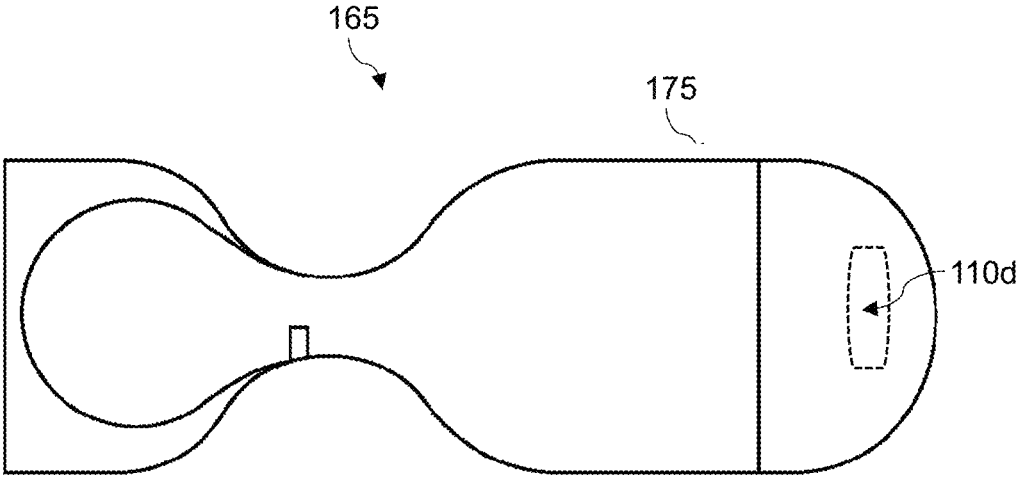
Figure 5C:
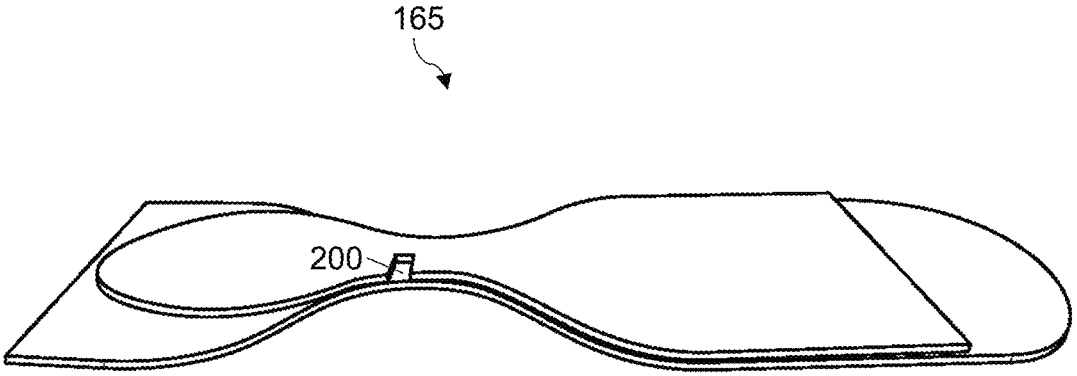
Figure 5D:
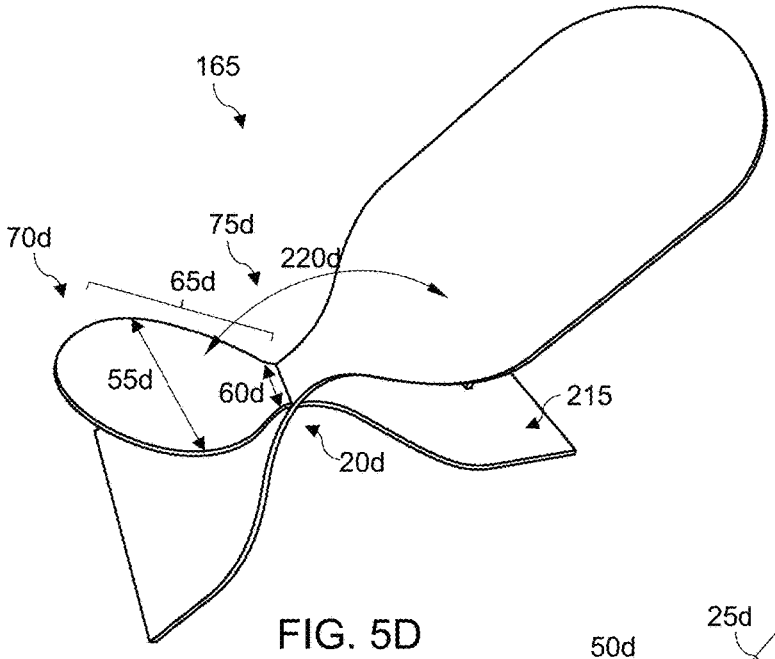
FIGS. 5D-5F display multiple views of the saddle sleeper of FIGS. 5A-5C unfolded.
Figure 5E:
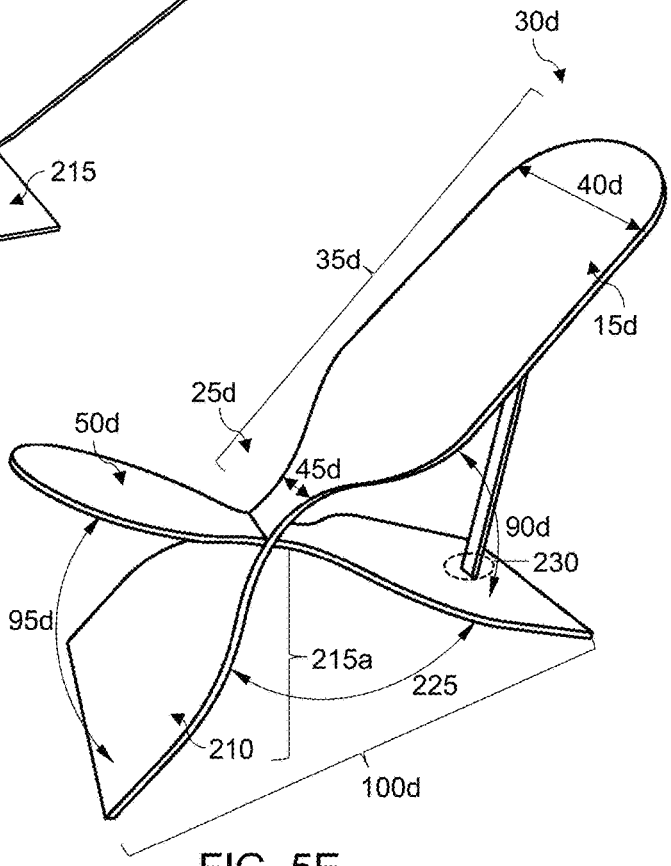
Figure 5F:
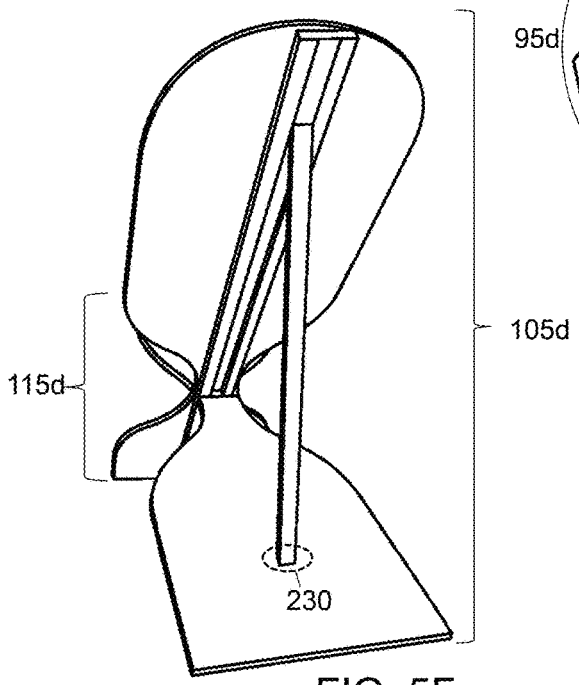

There exists a need for an improved saddle or straddle sleeper 5, 135, 155, 165 that enables a person to eliminate or reduce one or more symptoms while they are sleeping. The saddle or straddle sleeper 5, 135, 155, 165 is designed to enable a person to sleep on their stomachs or upper torso in an angled orientation while still enabling them to touch the ground to aid in stability (see FIGS. 2A-2B). The angled orientation of the sleeper 5, 135, 155, 165 allows a person to take advantage of gravity to simulate or substantially simulate the natural drainage and blood flow of the body while a person is sitting upright. The angled orientation also helps reduce or eliminate coughing and/or congestion while trying to sleep.

Accordingly, the sleeper 5, 135, 155, 165 can also be used for a variety of other medical applications or medical conditions that require the improvement of symptoms while at an angled orientation, including persons who may have cystic fibrosis, acid reflux, night-time cough, sleep apnea, sinus congestion, other pulmonary conditions, ear infections, glaucoma, ocular hypertension, cold, flu, allergies and/or any combination thereof. The first and second surface angles or angled orientations may match or substantially match the angle needed for proper postural drainage therapy (15 to 45 degrees) and/or the reduction or elimination of symptoms of any relevant medical conditions. The sleeper 5, 135, 155, 165 further comprises different sizes. The sizes may include general sizing such as small, medium, large or x-large. Also, the size may include custom sized sleepers 5, 135, 155, 165 for any person, the persons include adults and children.

The sleeper 5, 135, 155, 165 comprises a forward-facing surface that can be sized and configured for different persons, including adults, children and/or toddlers. The sleeper 5, 135, 155, 165 can sit on a floor for easy access and safety. It may also be positioned next to a bed if desired to add further stability and support. The sleeper 5, 135, 155, 165 can include an angled forward-leaning seat that supports the buttocks with another angled platform surface for supporting the upper torso (e.g., chest and abdomen) and head to rest thereto.

In one embodiment, the sleeper 5, 135, 155, 165 comprises a first surface 15*a*, 15*b*, 15*c*, 15*d*, a second surface 50*a*, 50*b*, 50*c*, 50*d* and a base 10*a*, 10*b*, 10*c*, 10*d*; the base 10*a*, 10*b*, 10*c*, 10*d* supports the first surface 15*a*, 15*b*, 15*c*, 15*d* and the second surface 50*a*, 50*b*, 50*c*, 50*d*. The first surface 15*a*, 15*b*, 15*c*, 15*d*, the first surface 15*a*, 15*b*, 15*c*, 15*d* comprises a first top width 40*a*, 40*b*, 40*c*, 40*d*, a first bottom width 45*a*, 45*b*, 45*c*, 45*d*, a first surface shape and a first angle 95*a*, 95*b*, 95*c*, 95*d*, the first bottom width 45*a*, 45*b*, 45*c*, 45*d* is smaller than the first top width 40*a*, 40*b*, 40*c*, 40*d*, the first surface 15*a*, 15*b*, 15*c*, 15*d* is configured to contact or support at least a portion of a frontal plane or anterior facing anatomical regions of an upper torso of a person; the second surface 50*a*, 50*b*, 50*c*, 50*d* comprises a second top width 55*a*, 55*b*, 55*c*, 55*d*, a second bottom width 60*a*, 60*b*, 60*c*, 60*d*, a second surface shape and a second angle 90*a*, 90*b*, 90*c*, 90*d*, the second bottom width 60*a*, 60*b*, 60*c*, 60*d* is smaller than the second top width 55*a*, 55*b*, 55*c*, 55*d*, the second surface 50*a*, 50*b*, 50*c*, 50*d* is configured to contact or support at least a portion of a buttocks of a person or configured to support at least a portion of posterior facing anatomical regions of a person's lower torso; the first surface 15*a*, 15*b*, 15*c*, 15*d* and the second surface 50*a*, 50*b*, 50*c*, 50*d* intersect at an orientation angle 220*a*, 220*b*, 220*c*, 220*d* at an intersection region 20*a*, 20*b*, 20*c*, 20*d*, the intersection region 20*a*, 20*b*, 20*c*, 20*d* includes an intersection height 215*a*, 215*b*, 215*c*, 215*d* and an intersection shape.

In another embodiment, the sleeper comprises: the sleeper 5, 135, 155, 165 comprises a first surface 15*a*, 15*b*, 15*c*, 15*d*, a second surface 50*a*, 50*b*, 50*c*, 50*d* and a base 10*a*, 10*b*, 10*c*, 10*d*. The first surface 15*a*, 15*b*, 15*c*, 15*d* comprises a first surface width 40*a*, 40*b*, 40*c*, 40*d*, a first surface shape and a first surface angle 95*a*, 95*b*, 95*c*, 95*d*, the first surface 15*a*, 15*b*, 15*c*, 15*d* is configured to contact at least a portion of a frontal plane or anterior facing anatomical regions of an upper torso of a person; the second surface 50*a*, 50*b*, 50*c*, 50*d* comprises a second surface width 45*a*, 45*b*, 45*c*, 45*d*, a second surface shape and a second surface angle, the second surface 50*a*, 50*b*, 50*c*, 50*d* is configured to contact at least a portion of a buttocks of a person or configured to support at least a portion of posterior facing anatomical regions of a person's lower torso; the first surface 15*a*, 15*b*, 15*c*, 15*d* and the second surface 50*a*, 50*b*, 50*c*, 50*d* intersect at a non-parallel angle 220*a*, 220*b*, 220*c*, 220*d* at an intersection region, the intersection region 20*a*, 20*b*, 20*c*, 20*d* includes an intersection width, intersection height 215*a*, 215*b*, 215*c*, 215*d*, and an intersection shape, the intersection width comprises a smaller width than the first surface width 40*a*, 40*b*, 40*c*, 40*d* and a second surface width 45*a*, 45*b*, 45*c*, 45*d*; and the base 10*a*, 10*b*, 10*c*, 10*d* is supporting the first surface 15*a*, 15*b*, 15*c*, 15*d* and the second surface 50*a*, 50*b*, 50*c*, 50*d*.

Referring to FIGS. 1A-1C, 2A-2B, 3A-3D, 4A-4H, and 5D-5F, the sleeper 5, 135, 155, 165 comprises a first surface 15*a*, 15*b*, 15*c*, 15*d*, a second surface 50*a*, 50*b*, 50*c*, 50*d* and a base 10*a*, 10*b*, 10*c*, 10*d*. The base 10*a*, 10*b*, 10*c*, 10*d* supports the first surface 15*a*, 15*b*, 15*c*, 15*d* and the second surface 50*a*, 50*b*, 50*c*, 50*d*. The first surface 15*a*, 15*b*, 15*c*, 15*d* comprises a first top end 30*a*, 30*b*, 30*c*, 30*d*, a first bottom end 25*a*, 25*b*, 25*c*, 25*d*, a first surface shape, a first top width 40*a*, 40*a*, 40*c*, 40*d*, a first bottom width 45*a*, 45*b*, 45*c*, 45*d*, a first surface height 105*a*, 105*b*, 105*c*, 105*d*, a first surface length 35*a*, 35*b*, 35*c*, 35*c* and/or a first surface angle 95*a*, 95*b*, 95*c*, 95*d*.

The first top width 40*a*, 40*b*, 40*c*, 40*d* is at or adjacent to the first top end 30*a*, 30*b*, 30*c*, 30*d*. The first top width 40*a*, 40*b*, 40*c*, 40*d* comprises a width of at least 15 inches or greater; comprises a width of 17 inches or greater; comprises a width of 15 inches to 20 inches; and/or comprises a width of 16 to 18 inches. The first bottom width 45*a*, 45*b*, 45*c*, 45*d* is at or adjacent to the first bottom end 25*a*, 25*b*, 25*c*, 25*d*. The first bottom width 45*a*, 45*b*, 45*c*, 45*d* comprises a width of at least 5 inches or greater; comprises a width of at least 6 inches or greater; comprises a width of 4 to 10 inches; comprises a width of 5 to 8 inches; and/or comprises a width of 6 to 8 inches. Accordingly, the first top width 40*a*, 40*b*, 40*c*, 40*d* is greater than the first bottom width 45*a*, 45*b*, 45*c*, 45*d*. The first bottom width 45*a*, 45*b*, 45*c*, 45*d* comprises a smaller width than the first top width 40*a*, 40*b*, 40*c*, 40*d*.

The first surface 15*a*, 15*b*, 15*c*, 15*d* comprises a first surface angle 95*a*, 95*b*, 95*c*, 95*d*. The first surface angle 95*a*, 95*b*, 95*c*, 95*d* is positioned relative to the floor and/or the longitudinal axis 85. The first surface angle 95*a*, 95*b*, 95*c*, 95*d* comprises an angle of at least 20 degrees or greater; comprises an angle of at least 25 degrees or greater; comprises an angle of 30 degrees or greater; comprises an angle of 35 degrees or greater; comprises an angle of 40 degrees or greater; comprises an angle of 20 degrees to 50 degrees; comprises an angle of 30 degrees to 50 degrees; and/or comprises an angle of 35 degrees to 45 degrees.

The first surface 15*a*, 15*b*, 15*c*, 15*d* comprises a first surface height 105*a*, 105*b*, 105*c*, 105*d*. The first surface height 105*a*, 105*b*, 105*c*, 105*d* comprises a height of at least 15 inches or greater; the first surface height 105*a*, 105*b*, 105*c*, 105*d* comprises of at least 20 inches or greater; the height comprises at least 23 inches or greater; the height comprises 15 inches to 25 inches; the height comprises at least 20 inches to 25 inches; and/or the height comprises 22 inches to 24 inches. The first surface height 105*a*, 105*b*, 105*c*, 105*d* may be at or adjacent to the first top end 30*a*, 30*b*, 30*c*, 30*d* of the first surface 15*a*, 15*b*, 15*c*, 15*d*.

The first surface 15*a*, 15*b*, 15*c*, 15*d* comprises a first surface length 35*a*, 35*b*, 35*c*, 35*d*. The first surface length 35*a*, 35*b*, 35*c*, 35*d* comprises a length of at least 15 inches or greater; comprises a length of at least 20 inches or greater; comprises a length of at least 25 inches or greater; comprises a length of at least 28 inches or greater; comprises a length of 20 inches to 30 inches; comprises a length of 25 inches to 30 inches; and/or comprises a length of 27 inches to 29 inches.

The first surface 15*a*, 15*b*, 15*c*, 15*d* comprises a first surface shape. The first surface shape may include a profile shape, the profile shape comprises a flat, curved or concave surface. The curved or concave shaped surface may be sized and configured to accommodate a person's torso, e.g., an adult or a child. The first surface shape may further include an oval, circular, and/or any polygonal shape. The polygonal shape includes a triangle, a square, a rectangle, a heptagon, a hexagon, and/or any combination thereof. The first surface shapes may further include rounded polygonal shapes, such as a rounded-triangle, a rounded-square, a rounded rectangular, a rounded-heptagon, a rounded-hexagon, and/or any combination thereof.

Also, referring to FIGS. 1A-1C, 2A-2B, 3A-3D, 4A-4H, and 5D-5F, the sleeper 5, 135, 155, 165 comprises a second surface 50*a*, 50*b*, 50*c*, 50*d*. The second surface 50*a*, 50*b*, 50*c*, 50*d* comprises a second top end 70*a*, 70*b*, 70*c*, 70*d*, a second bottom end 75*a*, 75*b*, 75*c*, 75*d*, a second surface shape, a second top width 55*a*, 55*b*, 55*c*, 55*d*, a second bottom width 60*a*, 60*b*, 60*c*, 60*d*, a second surface height 115*a*, 115*b*, 115*c*, 115*d*, and/or a second surface angle 90*a*, 90*b*, 90*c*, 90*d*.

The second top width 55*a*, 55*b*, 55*c*, 55*d* is at or adjacent to the second top end 70*a*, 70*b*, 70*c*, 70*d*. The second top width 55*a*, 55*b*, 55*c*, 55*d* comprises a width of at least 5 inches or greater; comprises a width of 10 inches or greater; comprises a width of 5 inches to 15 inches; and/or comprises a width of 8 to 11 inches. The second bottom width 60*a*, 60*b*, 60*c*, 60*d* is at or adjacent to the second bottom end 75*a*, 75*b*, 75*c*, 75*d*. The second bottom width 60*a*, 60*b*, 60*c*, 60*d* comprises a width of at least 2 inches or greater; comprises a width of at least 4 inches or greater; comprises a width of 2 to 6 inches; comprises a width of 3 to 6 inches; and/or comprises a width of 4 to 5 inches. Accordingly, the second top width 55*a*, 55*b*, 55*c*, 55*d* is greater than the second bottom width 60*a*, 60*b*, 60*c*, 60*d*. The second bottom width 60*a*, 60*b*, 60*c*, 60*d* comprises a smaller width than the second top width 55*a*, 55*b*, 55*c*, 55*d*.

The second surface 50*a*, 50*b*, 50*c*, 50*d* comprises a second surface angle 90*a*, 90*b*, 90*c*, 90*d*. The second surface angle 90*a*, 90*b*, 90*c*, 90*d* is positioned relative to the floor and/or the longitudinal axis 85. The second surface angle 90*a*, 90*b*, 90*c*, 90*d* comprises an angle of at least 20 degrees or greater; comprises an angle of at least 25 degrees or greater; comprises an angle of 30 degrees or greater; comprises an angle of 35 degrees or greater; comprises an angle of 40 degrees or greater; comprises an angle of 20 degrees to 50 degrees; comprises an angle of 30 degrees to 50 degrees; and/or comprises an angle of 35 degrees to 45 degrees.

The second surface 50*a*, 50*b*, 50*c*, 50*d* comprises a second surface height 115*a*, 115*b*, 115*c*, 115*d*. The second surface height 115*a*, 115*b*, 115*c*, 115*d* comprises a height of at least 15 inches or greater; the first surface height 105*a*, 105*b*, 105*c*, 105*d* comprises of at least 10 inches or greater; the height comprises at least 13 inches or greater; the height comprises a 10 inches to 15 inches; the height comprises at least 10 inches to 14 inches; and/or the height comprises 12 inches to 14 inches. The second surface height 115*a*, 115*b*, 115*c*, 115*d* may be at or adjacent to the second top end 70*a*, 70*b*, 70*c*, 70*d* of the second surface 50*a*, 50*b*, 50*c*, 50*d*.

The second surface 50*a*, 50*b*, 50*c*, 50*d* comprises a second surface length 65*a*, 65*b*, 65*c*, 65*d*. The second surface length 65*a*, 65*b*, 65*c*, 65*d* comprises a length of at least 5 inches or greater; comprises a length of at least 7 inches or greater; comprises a length of at least 10 inches or greater; comprises a length of 5 inches to 15 inches; comprises a length of 7 inches to 13 inches; and/or comprises a length of 10 inches to 12 inches.

The second surface 50*a*, 50*b*, 50*c*, 50*d* comprises a second surface shape. The second surface shape may include a flat, curved or concave surface. The curved or concave shaped surface may be sized and configured to accommodate a person's torso, e.g., an adult or a child. The first surface shape may further include oval, circular, and/or any polygonal shape. The polygonal shape includes a triangle, a square, a rectangle, a heptagon, a hexagon, and/or any combination thereof. The second surface shapes may further include rounded polygonal shapes, such as a rounded-triangle, a rounded-square, a rounded rectangular, a rounded-heptagon, a rounded-hexagon, and/or any combination thereof.

In one embodiment, the first surface angle 95*a*, 95*b*, 95*c*, 95*d* may comprise a same angle than the second surface angle 90*a*, 90*b*, 90*c*, 90*d*. The first surface angle 95*a*, 95*b*, 95*c*, 95*d* may comprise a different angle than the second surface angle 90*a*, 90*b*, 90*c*, 90*d*. The first surface height 105*a*, 105*b*, 105*c*, 105*d* may comprise a same height than the second surface height 115*a*, 115*b*, 115*c*, 115*d*. The first surface height 105*a*, 105*b*, 105*c*, 105*d* may comprise a different height than the second surface height 115*a*, 115*b*, 115*c*, 115*d*. The first top width 40*a*, 40*b*, 40*c*, 40*d* may comprise a same width than the second top width 55*a*, 55*b*, 55*c*, 55*d*. The first top width 40*a*, 40*b*, 40*c*, 40*d* may comprise a different width than the second top width 55*a*, 55*b*, 55*c*, 55*d*. The first bottom width 45*a*, 45*b*, 45*c*, 45*d* may comprise a same width as the second bottom width 60*a*, 60*b*, 60*c*, 60*d*. The first bottom width 45*a*, 45*b*, 45*c*, 45*d* may comprise a different width as the second bottom width 60*a*, 60*b*, 60*c*, 60*d*. The first surface shape may comprise a same shape as the second surface shape. The first surface shape may comprise a different shape as the second surface shape. The first surface length 35*a*, 35*b*, 35*c*, 35*d* may comprise a same length as the second surface length 65*a*, 65*b*, 65*c*, 65*d*. The first surface length 35*a*, 35*b*, 35*c*, 35*d* may comprise a different length as the second surface length 65*a*, 65*b*, 65*c*, 65*d*.

In another embodiment, the first surface 15*a*, 15*b*, 15*c*, 15*d* is in a surface orientation angle 220*a*, 220*b*, 220*c*, 220*d* relative to the second surface 50*a*, 50*b*, 50*c*, 50*d*. The surface orientation angle 220*a*, 220*b*, 220*c*, 220*d* comprises an obtuse angle. The surface orientation angle 220*a*, 220*b*, 220*c*, 220*d* comprises an angle of 90 degrees or greater; the surface orientation angle 220*a*, 220*b*, 220*c*, 220*d* comprises an angle of 100 degrees or greater; the surface orientation angle 220*a*, 220*b*, 220*c*, 220*d* comprises an angle of 105 degrees or greater; the surface orientation angle 220*a*, 220*b*, 220*c*, 220*d* comprises an angle of 90 degrees to 170 degrees; the surface orientation angle 220*a*, 220*b*, 220*c*, 220*d* comprises an angle of 90 degrees to 150 degrees; the surface orientation angle 220*a*, 220*b*, 220*c*, 220*d* comprises an angle of 90 degrees to 130 degrees; and/or the surface orientation angle 220*a*, 220*b*, 220*c*, 220*d* comprises an angle of 90 degrees 110 degrees. The first surface 15*a*, 15*b*, 15*c*, 15*d* is non-parallel to the second surface 50*a*, 50*b*, 50*c*, 50*d*.

In another embodiment, the first surface 15*a*, 15*b*, 15*c*, 15*d* is intended or configured to contact, engage or support the anterior facing portions and/or the ventral region of a person's upper torso and head. The upper torso comprises a middle trunk and an upper trunk as shown in FIGS. 6A-6B. Accordingly, the second surface 50*a*, 50*b*, 50*c*, 50*d* is intended or configured to contact, engage or support the posterior facing portions and/or the dorsal region of a person's buttocks of the lower trunk. A person's ventral region should be facing at least a portion of the first surface 15*a*, 15*b*, 15*c*, 15*d* to straddle the sleeper 5, 135, 155, 165. The person should position their buttocks onto the second surface 50*a*, 50*b*, 50*c*, 50*d* and position the ventral region of their upper torso onto the first surface 50*a*, 50*b*, 50*c*, 50*d*. The person's upper legs should straddle the intersection region 20*a*, 20*b*, 20*c*, 20*d* comfortably without straining the upper legs or inner thighs, and the intersection region height 215*a*, 215*b*, 215*c*, 215*d* should enable the knees of the upper legs to be positioned at 90 degrees or substantially 90 degrees while a portion of the person's feet touch the ground. Alternatively, the intersection region height 215*a*, 215*b*, 215*c*, 215*d* should enable the knees of the upper legs to be positioned at 80 degrees or less while a portion of the person's feet touch the ground. The 80 degrees or less creates the open body angle by lowering the angle of the lower body, keeping the spine in alignment and the person properly positioned to sleep. The benefit of this position is that if one leans inward, the body angle remains 90° or wider.

Also, referring to FIGS. 1A-1C, 2A-2B, 3A-3D, 4A-4H, and 5D-5F, the sleeper 5, 135, 155, 165 comprises an intersection region 20*a*, 20*b*, 20*c*, 20*d*. The intersection region 20*a*, 20*b*, 20*c* 20*d* comprises an intersection width and an intersection height 215*a*, 215*b*, 215*c*, 215*c*. The intersection width may comprise the same or substantially the same as the first bottom width 45*a*, 45*b*, 45*c*, 45*d* or the second bottom width 60*a*, 60*b*, 60*c*, 60*d*. The intersection width may comprise the same or substantially the same as the first bottom width 45*a*, 45*b*, 45*c*, 45*d* and the second bottom width 60*a*, 60*b*, 60*c*, 60*d*. The intersection height 215*a*, 215*b*, 215*c*, 215*c* may comprise a height of 3 inches to 10 inches; may comprise a height of 5 inches to 8 inches; may comprise a height of at least 3 inches or greater; may comprise a height of at least 5 inches or greater; and/or may comprise a height of at least 7 inches or greater.

Alternatively, the intersection width may match or substantially match a person's sit bone width. The person may include an adult male, an adult female, a female child and/or a male child. The sit bone width is defined as the ischial tuberosity spacing among men, women and children. The intersection width should be wide enough to allow the person to straddle the sleeper 5, 135, 155, 165 without straining the inner thighs and comfortable enough to match or substantially match a person's sit bone width. The intersection height 215*a*, 215*b*, 215*c*, 215*c* should sufficiently allow the person to bend their legs in a 90-degree position or a substantially 90 degree position enabling at least a portion of the person's feet to touch the ground. Furthermore, at least a portion of the person's feet should be capable of reaching the ground to provide stability while sleeping and preventing them from falling off the sleeper 5, 135, 155, 165.

Also, referring to FIGS. 1A-1C, 2A-2B, 3A-3D, 4A-4H, and 5D-5F, the sleeper 5, 135, 155, 165 may comprise a base 10*a*, 10*b*, 10*c*, 10*d*. The base 10*a*, 10*b*, 10*c*, 10*d* supports the first surface 15*a*, 15*b*, 15*c*, 15*d* and the second surface 50*a*, 50*b*, 50*c*, 50*d*. The base 10*a*, 10*b*, 10*c*, 10*d* further comprises a flange 140 and/or one or more handle openings 110*a*, 110*b*, 110*c*, 110*d*. The flange 140 may be disposed at or adjacent to the bottom of the base 10*a*, 10*b*, 10*c*, 10*d* and/or surrounds the perimeter of the base 10*a*, 10*b*, 10*c*, 10*d*. The one or more handle openings 110*a*, 110*b*, 110*c*, 110*d* may be disposed onto the front, back, right or left sides of the base 10*a*, 10*b*, 10*c*, 10*d*. The one or more handle openings 110*a*, 110*b*, 110*c*, 110*d* may be sized and configured to receive a portion of a person's hand to enable the sleeper 5, 135, 155, 165 to be portable and moved easily.

In one embodiment, the sleeper 5, 135, 155, 165 and/or the base 10*a*, 10*b*, 10*c*, 10*d* may comprise a single-piece unit. The base 10*a*, 10*b*, 10*c*, 10*d* may comprise a first portion 210 and a second portion 215. The first portion 210 of the base 10*a*, 10*b*, 10*c*, 10*d* may comprise a first portion width, and a second portion 215 of the base 10*a*, 10*b*, 10*c*, 10*d* may comprise a second portion width. The first portion 210 of the base 10*a*, 10*b*, 10*c*, 10*d* supports the first surface 15*a*, 15*b*, 15*c*, 15*d*, and the second portion 215 of the base 10*a*, 10*b*, 10*c*, 10*d* supports the second surface 50*a*, 50*b*, 50*c*, 50*d*. The first portion width of the base 10*a*, 10*b*, 10*c*, 10*d* may be equal to or greater than the first top width 40*a*, 40*b*, 40*c*, 40*d* of the first surface 15*a*, 15*b*, 15*c*, 15*d* and/or the first bottom width 45*a*, 45*b*, 45*c*, 45*d* of the first surface 15*a*, 15*b*, 15*c*, 15*d*. The second portion width of the base 10*a*, 10*b*, 10*c*, 10*d* may be greater than or equal to the second top width 55*a*, 55*b*, 55*c*, 55*d* and/or the second bottom width 60*a*, 60*b*, 60*c*, 60*d*. Alternatively, the base 10*a*, 10*b*, 10*c*, 10*d* may taper outwardly from the first surface 15*a*, 15*b*, 15*c*, 15*d* and the second surface 50*a*, 50*b*, 50*c*, 50*d* towards the floor or ground to create a wider perimeter at the ground or floor for stability. The single-piece unit may be manufactured using a standard molding process known in the art.

In another embodiment, the sleeper 5, 135, 155, 165 and/or the base 10*a*, 10*b*, 10*c*, 10*d* may comprise a multi-piece unit. The multi-piece unit relates to a lightweight, compact folding sleeper 5, 135, 155, 165 which is capable of being easily folded from its open sleeping position to a flat planar position. The multi-piece unit is movable from a first position, a flat planar and/or substantially flat planar folded position, to a second position, an open sleeping position. The open sleeping position may comprise adjustable or movable first surface 15*a*, 15*b*, 15*c*, 15*d* relative to the second surface 50*a*, 50*b*, 50*c*, 50*d*, and/or adjustable or movable first and second portions of the base 10*a*, 10*b*, 10*c*, 10*d*.

The base 10*a*, 10*b*, 10*c*, 10*d* may comprise a first portion 210 and a second portion 215. The first portion 210 of the base 10*a*, 10*b*, 10*c*, 10*d* may comprise a first portion width, and a second portion 215 of the base 10*a*, 10*b*, 10*c*, 10*d* may comprise a second portion width. The first portion 210 of the base 10*a*, 10*b*, 10*c*, 10*d* supports the first surface 15*a*, 15*b*, 15*c*, 15*d*, and the second portion 215 of the base 10*a*, 10*b*, 10*c*, 10*d* supports the second surface 50*a*, 50*b*, 50*c*, 50*d*. The first portion width of the base 10*a*, 10*b*, 10*c*, 10*d* may be equal to or greater than the first top width 40*a*, 40*b*, 40*c*, 40*d* of the first surface 15*a*, 15*b*, 15*c*, 15*d* and/or the first bottom width 45*a*, 45*b*, 45*c*, 45*d* of the first surface 15*a*, 15*b*, 15*c*, 15*d*. The second portion width of the base 10*a*, 10*b*, 10*c*, 10*d* may be greater than or equal to the second top width 55*a*, 55*b*, 55*c*, 55*d* and/or the second bottom width 60*a*, 60*b*, 60*c*, 60*d*.

The first portion of the base 10*a*, 10*b*, 10*c*, 10*d* is movable relative to the second portion of the base 10*a*, 10*b*, 10*c*, 10*d* at one or more base orientation angles 225. The one or more base orientation angles 225 may be locked into position by a locking mechanism or latch mechanism 180. In one embodiment, the one or more base orientation angles 225 comprises an obtuse angle. The one or more base orientation angle 225 comprises an angle of 90 degrees or greater; the one or more base orientation angles 225 comprises an angle of 100 degrees or greater; the one or more base orientation angles 225 comprises an angle of 105 degrees or greater; the one or more base orientation angles 225 comprises an angle of 90 degrees to 170 degrees; the one or more base orientation angles 225 comprises an angle of 90 degrees to 150 degrees; the one or more base orientation angles 225 comprises an angle of 90 degrees to 130 degrees; and/or the one or more base orientation angles 225 comprises an angle of 90 degrees 110 degrees. The first portion of the base 10*a*, 10*b*, 10*c*, 10*d* is non-parallel to the second portion of the base 10*a*, 10*b*, 10*c*, 10*d*. In another embodiment, the one or more base orientation angles 225 comprises 180 degrees or substantially 180 degrees when the base 10*a*, 10*b*, 10*c*, 10*d* and/or sleeper 5, 135, 155, 165 is in its folded, flat planar configuration. Alternatively, the one or more base orientation angle 225 comprises 90 degrees to 110 degrees of adjustability when the base 10*a*, 10*b*, 10*c*, 10*d* and/or the sleeper 5, 135, 155, 165 is in its one or more open, unfolded configurations. The one or more base orientation angles 225 may comprise a same or different angle than the one or more surface orientation angles 220*a*, 220*b*, 220*c*, 220*d*. The one or more base orientation angles 225 may match or substantially match the one or more surface orientation angles 220*a*, 220*b*, 220*c*, 220*d* while in the unfolded one or more positions or configurations.

In one embodiment, the locking or latch mechanism 180 may comprise a rail 185, 190 and a rod or stand 195. The locking or latch mechanism 180 may further comprise a pin (not shown). The rail 185, 190 may be disposed on the first surface 15*a*, 15*b*, 15*c*, 15*d* second surface 50*a*, 50*b*, 50*c*, 50*d*, the base 10*a*, 10*b*, 10*c*, 10*d*, a first portion of the base 10*a*, 10*b*, 10*c*, 10*d* and/or a second portion of the base 10*a*, 10*b*, 10*c*, 10*d*. The rail 185, 190 may be disposed along the length and/or the vertical axis of the first surface 15*a*, 15*b*, 15*c*, 15*d* second surface 50*a*, 50*b*, 50*c*, 50*d*, the base 10*a*, 10*b*, 10*c*, 10*d*, a first portion of the base 10*a*, 10*b*, 10*c*, 10*d* and/or a second portion of the base 10*a*, 10*b*, 10*c*, 10*d*.

The rail 185, 190 comprises a first elongated member 185 and a second elongated member 190 that are spaced apart to create a channel, and the first elongated member 185 and second elongated member 190 are parallel to each other. The rod or stand 195 is disposed between the first elongated member 185 and the second elongated member 190 within the channel. The rod or stand 195 may comprise one or more notches, holes or hooks disposed along the length that are spaced apart to provide different base orientation angles 225 and/or surface angled orientations. The rod or stand 195 may be pivotally connected to at least a portion of the rail 185, 190. The rail 185, 190 is movable from a first position, a folded, unlocked position that is parallel to the rail 185, 190, to a second position, an unfolded, locked position. At least a portion of the rod or stand 195 may be inserted into a recess or opening 230. The recess or opening 230 may be sized and configured to receive at least portion of the rod or stand 195. The pin (not shown) may extend through the one or more notches, holes or hooks transversely to prevent the rod or stand 195 from sliding or moving further, thus locking the rod or stand 195 at the selected one or more base orientation angles 225. Alternatively, the pin (not shown) may engage with the one or more notches, holes or hooks to prevent the rod or stand 195 from sliding, thus locking the rod or stand 195 at the selected on or more base orientation angles 225.

Also, referring to FIGS. 1A-1C, 2A-2B, 3A-3D, 4A-4H, and 5D-5F, the sleeper 5, 135, 155, 165 may comprise a weight. The sleeper 5, 135, 155, 165 should be lightweight to increase portability. The weight of the sleeper 5, 135, 155, 165 comprises at least 1 lb or greater. The weight may further comprise 1 lb to 10 lb. Alternatively, the sleeper 5, 135, 155, 165 may comprise 10 lb or less. In another embodiment, the sleeper 5, 135, 155, 165 may include wheels or other portability mechanisms. In another embodiment, the sleeper 5, 135, 155, 165 may comprise one or more colors and/or a combination of colors.

Also, referring to FIGS. 1A-1C, 2A-2B, 3A-3D, 4A-4H, and 5D-5F, the sleeper 5, 135, 155, 165 comprises a material. The material may be a plastic, foam, or metal. The plastic may comprise a thermoset or thermoplastic. The plastic may comprise polypropylene (PP), polyethylene (PE), polyvinyl chloride (PVC), acrylonitrile butadiene styrene (ABS), polycarbonate (PC), and/or any combination thereof. The foam may comprise high-density polystyrene foam (HDPS), expanded polystyrene foam (EPS), polyurethane foam, craft foam, and/or any combination thereof. In another embodiment, the saddle sleeper may be solid or hollow. The material may further comprise a biodegradable material, an environmentally friendly or eco-friendly material.

Also, referring to FIGS. 1A-1C, 2A-2B, 3A-3D, 4A-4H, and 5D-5F, the sleeper 5, 135, 155, 165 may comprise one or more pads 125, 130. The one or more pads 125, 130 should increase comfort of the sleeper 5, 135, 155, 165. The one or more pads 125, 130 may be fixed or removably connected. The one or more pads 125, 130 may be disposed onto the first surface 15*a*, 15*b*, 15*c*, 15*d* or the second surface 50*a*, 50*b*, 50*c*, 50*d*. The one or more pads 125, 130 may be disposed onto each of the first surface 15*a*, 15*b*, 15*c*, 15*d* and the second surface 50*a*, 50*b*, 50*c*, 50*d*. The one or more pads 125, 130 may comprise components around the household, such as pillows, towels, or sheets that can increase the comfort of the sleeping child. The one or more pads 125, 130 may comprise attachment mechanisms, the attachment mechanisms include Velcro, adhesive, adhesive strips, and/or any mechanisms known in the art. The one or more pads 125, 130 may comprise removable coverings. The removable coverings may be separately washed and disposed onto the one or more pads 125, 130.

Also, referring to FIGS. 1A-1C, 2A-2B, 3A-3D, 4A-4H, and 5D-5F, the sleeper 5, 135, 155, 165 may comprise one or more guards or stops (not shown). The stop may be used to help prevent falling of the sleeping person. The stop may comprise a wall and/or a bar, and/or other mechanism to help prevent falls. The one or more rails or stops may be disposed onto the first surface 15*a*, 15*b*, 15*c*, 15*d* or the second surface 50*a*, 50*b*, 50*c*, 50*d*. The one or more guards or stops may be disposed onto each of the first surface 15*a*, 15*b*, 15*c*, 15*d* and the second surface 50*a*, 50*b*, 50*c*, 50*d*. The one or more guards extend along at least a portion of a first length 35*a*, 35*b*, 35*c*, 35*d* of the first surface 15*a*, 15*b*, 15*c*, 15*d* and/or at least a portion of a second length 65*a*, 65*b*, 65*c*, 65*d* of the second surface 50*a*, 50*b*, 50*c*, 50*d*. In one embodiment, a first one or more guards are disposed on right side of the first surface 15*a*, 15*b*, 15*c*, 15*d* and a second one or more guards are disposed on the left side of the first surface 15*a*, 15*b*, 15*c*, 15*d*. Alternatively, the one or more guards or stops may be disposed onto the right side, left side, top end and/or bottom end of the first surface 15*a*, 15*b*, 15*c*, 15*d* and/or the second surface 50*a*, 50*b*, 50*c*, 50*d*.

The foregoing descriptions of specific embodiments of the saddle sleeper have been presented for purposes of illustration and description. They are not intended to be exhaustive or to limit the saddle sleeper to the precise forms disclosed, and obviously many modifications and variations are possible in light of the above teaching. The exemplary embodiment was chosen and described in order to best explain the principles of the saddle sleeper and its practical application, to thereby enable others skilled in the art to best utilize the saddle sleeper and various embodiments with various modifications as are suited to the particular use contemplated.

I claim:

1. A sleeper comprising:

a substantially rigid first support surface, the substantially rigid first support surface comprises a first average surface width, a first surface shape and a first surface angle;

a substantially rigid second support surface, the substantially rigid second support surface comprises a second average surface width, a second surface shape and a second surface angle;

the substantially rigid first support surface and the substantially rigid second support surface intersect at an intersection region at a surface orientation angle, the intersection region includes an intersection height and an intersection width, the intersection width being less than either of the second average surface width or the first average surface width; and a base having at least one vertically extending support wall, the base connected to and supporting at least one of the substantially rigid first support surface and the substantially rigid second support surface from a perimeter edge thereof.

2. The sleeper of claim 1, wherein the sleeper is a one-piece molded unit with a hollow cavity formed therein.

3. The sleeper of claim 1, wherein the first surface angle comprises a different angle than the second surface angle.

4. The sleeper of claim 1, wherein the sleeper further comprises a plurality of pads, each of the plurality of pads are disposed over at least one of the substantially rigid first support surface and the substantially rigid second support surface.

5. The sleeper of claim 1, wherein the first surface shape or the second surface shape comprises a planar, flat surface shape.

6. The sleeper of claim 1, wherein the first surface shape or the second surface shape comprises a concave surface shape.

7. The sleeper of claim 1, wherein the substantially rigid first support surface is configured to support at least a portion of a ventral side of an upper torso of a person and the substantially rigid second support surface is configured to support at least a portion of a dorsal side of a buttocks of a person.

8. The sleeper of claim 1, wherein the base comprises a first portion width and a second portion width, the first portion width is greater than the first average surface width, and the second portion width is greater than the second average surface width and second bottom width.

9. The sleeper of claim 1, wherein the sleeper is an adjustable, multi-piece unit.

10. The sleeper of claim 9, wherein the substantially rigid first surface is pivotally connected to the substantially rigid second surface to allow the substantially rigid first surface to move relative to the substantially rigid second surface.

11. The sleeper of claim 1, wherein the first surface angle of the substantially rigid first surface or the second surface angle of the substantially rigid second surface comprises an angle from 35 degrees to 45 degrees.

12. A sleeper comprising:

a first non-flexible support surface, the first non-flexible support surface comprises a first surface width, a first surface shape and a first surface angle, the first non-flexible support surface is configured to support at least a portion of a ventral side of an upper torso of a person;

a second non-flexible support surface, the second non-flexible support surface comprises a second surface width, a second surface shape and a second surface angle, the second non-flexible support surface is configured to support least a portion of a buttocks of a person;

the first non-flexible support surface and the second non-flexible support surface intersect at a surface orientation angle at an intersection region, the intersection region includes an intersection width and an intersection height, the intersection width comprises a smaller width than the first surface width and the second surface width; and a base having at least one tapered support wall with an upper end and a lower end, the upper end of the at least one tapered support wall connected to and support either a first perimeter of the first non-flexible supporting surface or a second perimeter of the second non-flexible support surface.

13. The sleeper of claim 12, wherein the sleeper comprises a unitary molded polymer unit.

14. The sleeper of claim 12, wherein the sleeper further comprises a plurality of pads, each of the plurality of pads are disposed onto at least one of the first non-flexible support surface and the second non-flexible support surface.

15. The sleeper of claim 12, wherein the first non-flexible support surface shape or the second non-flexible support surface shape comprises a planar, flat surface.

16. The sleeper of claim 12, wherein the first non-flexible support surface shape or the second non-flexible support surface shape comprises a concave surface.

17. The sleeper of claim 12, wherein the upper end of the at least one tapered support wall of the base comprises an upper end width and the lower end of the at least one tapered support wall of the base comprises a lower end width, the lower end width is greater than the upper end width.

18. The sleeper of claim 12, wherein the surface orientation angle comprises an angle of 80 degrees to 110 degrees.

19. The sleeper of claim 12, wherein the lower end of the at least one tapered support wall of the base comprises a flange.

* * * * *